US005815363A

United States Patent [19]

Chu

[11] Patent Number: 5,815,363

[45] Date of Patent: Sep. 29, 1998

[54] CIRCUIT BREAKER

[75] Inventor: Raymond Wai Hang Chu, Chai Wan, Hong Kong

[73] Assignee: Defond Manufacturing Limited, Chai Wan, Hong Kong

[21] Appl. No.: 724,468

[22] Filed: Oct. 1, 1996

[51] Int. Cl.[6] ..... H01H 47/06

[52] U.S. Cl. ..... 361/154; 335/27

[58] Field of Search ..... 361/154; 335/27, 335/150

[56] References Cited

U.S. PATENT DOCUMENTS

| | | | |
|---|---|---|---|
| 2,386,149 | 10/1945 | Smith | 361/154 |
| 3,883,781 | 5/1975 | Cotton | 361/37 |
| 4,387,356 | 6/1983 | Takemura et al. | 335/6 |
| 5,168,418 | 12/1992 | Hurley et al. | 361/155 |

FOREIGN PATENT DOCUMENTS 525510 8/1940 United Kingdom .

*Primary Examiner*—Fritz Fleming

*Attorney, Agent, or Firm*—Leydig, Voit & Mayer, Ltd.

[57] ABSTRACT

A circuit breaker comprising a switch for controlling the connection of a load to a power source, the switch having a fixed contact and a movable switch contact supported on a pivotable switching member and resiliently biased away from the fixed contact. The circuit breaker includes a solenoid having a first winding for initially moving the movable contact towards the fixed contact and a second winding for holding the movable contact against the fixed contact, a fault detection circuit adapted to detect a fault at the load and in response to disable the solenoid, and a reset switch for initially enabling energization of the first winding and when the movable contact is sufficiently close to or in contact with the fixed contact for subsequently enabling energization of the second winding. The reset switch is arranged to be operated by a part of the switching member by virtue of the movement of the movable contact in order to control energization of the windings.

12 Claims, 4 Drawing Sheets

CIRCUIT BREAKER

BACKGROUND OF THE INVENTION

Circuit breakers for controlling the connection of a load to a power source are generally known. A typical circuit breaker incorporates a switch having a fixed contact and a moving contact resiliently biassed off the fixed contact, a solenoid for moving or holding the moving contact against the fixed contact, a fault detection circuit for detecting a fault at the load and then disabling the solenoid to open the switch, and reset means for subsequently resetting the condition of the switch and solenoid. More specifically, the solenoid may have two windings, one for initially moving the moving contact towards the fixed contact and the other for subsequently holding the moving contact against the fixed contact.

The invention provides a modified circuit breaker of this type.

SUMMARY OF THE INVENTION

According to a first aspect of the invention, there is provided a circuit breaker which comprises a main switch for controlling the connection of a load to a power source, the main switch having a fixed contact and a movable switch contact supported on a pivotable switching member and resiliently biassed away from the fixed contact, a solenoid having a first winding for initially moving the movable contact towards the fixed contact and a second winding for holding the movable contact against the fixed contact, a fault, detection circuit adapted to detect the occurrence of a fault at the load and, in response, to disable the solenoid, and reset means comprising a reset switch adapted to initially enable energization of the first winding and, when the movable contact is sufficiently close to or reaches the fixed contact, to subsequently enable energization of the second winding. The reset switch is arranged to be operated by a part of the switching member by virtue of the movement of the movable contact in order to control energization of the first and second windings.

Preferably, the first and second windings of the solenoid are connected in series.

In a preferred embodiment, the first winding is formed by relatively thick wire having a relatively small number of turns and the second winding is formed by relatively thin wire having a relatively large number of turns.

It is preferred that the reset means is adapted to enable energization of only the first winding at an initial stage and to enable energization of both the first and the second windings at a subsequent stage.

Preferably, the main switch and the reset switch are both arranged to be operated by the solenoid.

It is preferred that the reset means includes a manually operable switch.

Conveniently, the reset means is operable automatically upon recovery of power supplied by the power source.

According to a second aspect of the invention, there is provided a circuit breaker which comprises a switch for controlling: the connection of a load to a power source, the switch having a fixed contact and a movable switch contact resiliently biassed away from the fixed contact, a solenoid having a first winding for initially moving the movable contact towards the fixed contact and a second winding for holding the movable contact against the fixed contact, a fault detection circuit adapted to detect the occurrence of a fault at the load and in response to disable the solenoid, and reset means adapted to initially enable energization of the first winding and when the movable contact is sufficiently close to or in contact with the fixed contact to subsequently enable energization of the second winding. The reset means being operable automatically upon recovery of power supplied by the power source.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 4:
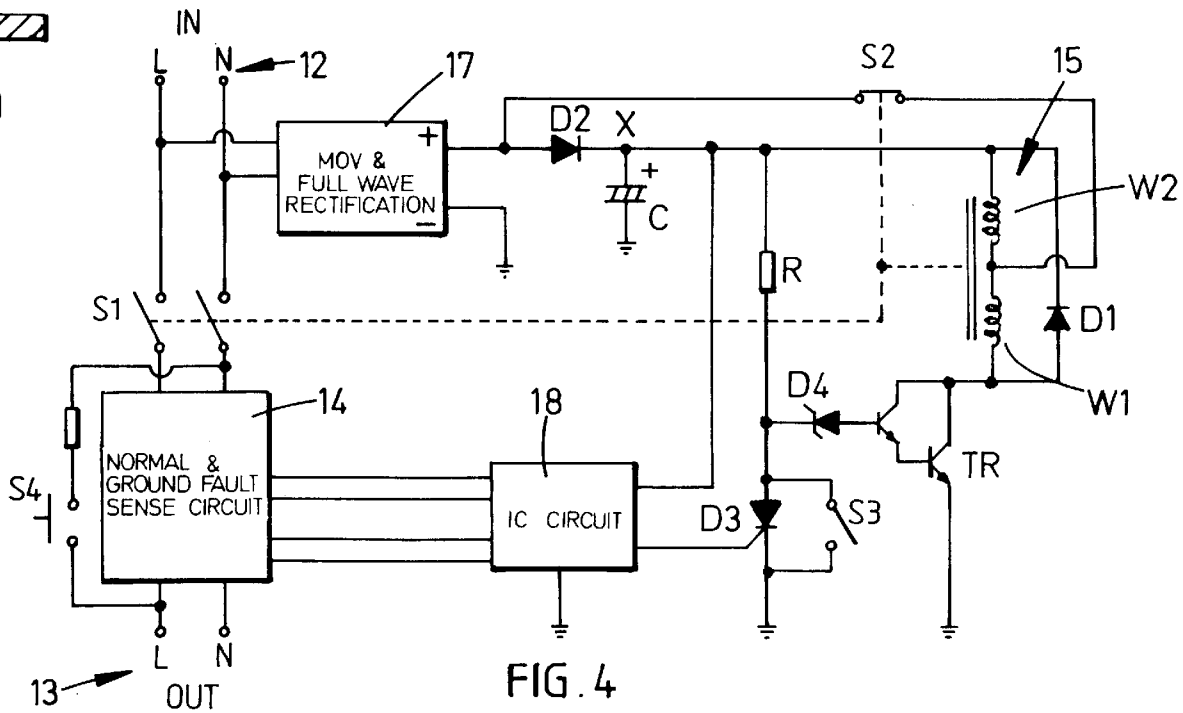
FIG. 4 is a circuit/block diagram of the circuit breaker of FIG. 3.

FIGS. 1 to 4 illustrate a circuit breaker 10 embodying the invention. The circuit breaker 10 comprises a casing 11 bearing, on its rear side, a set of three terminal pins 12 for plugging into an appropriate socket of an AC, power, source. As illustrated in FIG. 4, the circuit breaker 10 also includes a power cable 13 for connection to an electrical appliance (load). A fault detection circuit 14 is electrically connected between the terminal pins 12 and power cable 13 for detecting the occurrence of any accidental over-current and/or earth leakage fault at the load. The fault detection circuit 14 has a, configuration which is generally know in the art and, for the purpose of clarity, will not be described in detail. A push-button switch S4 is connected in series with a resistor across opposite sides of the fault detection circuit 14 for a user to create a simulated fault momentarily to test the operation of the circuit breaker 10.

Figure 1:
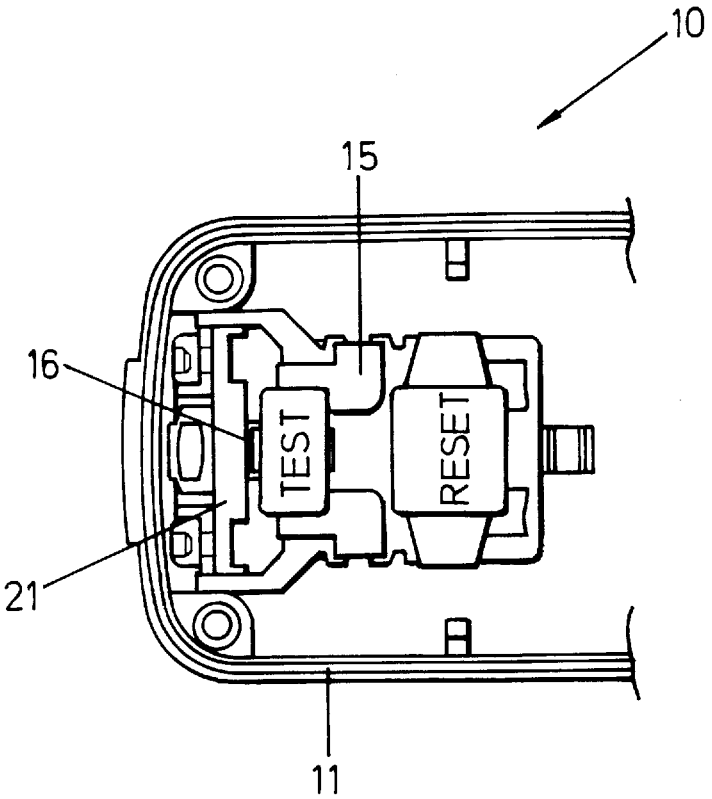
FIG. 1 is a fragmentary front view of an embodiment of a circuit breaker in accordance with the invention.
Figure 2:
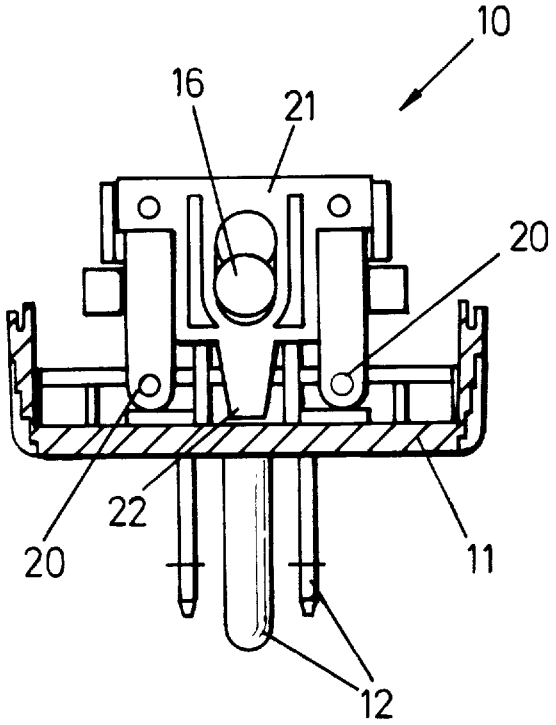
FIG. 2 is a fragmentary sectional end view of the circuit breaker of FIG. 1.
Figure 3A:
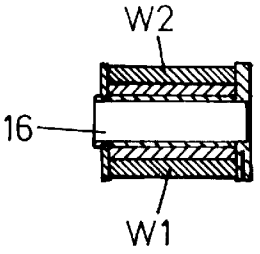
FIG. 3A is a sectional side view of a solenoid of the circuit breaker of FIG. 1.
Figure 3:
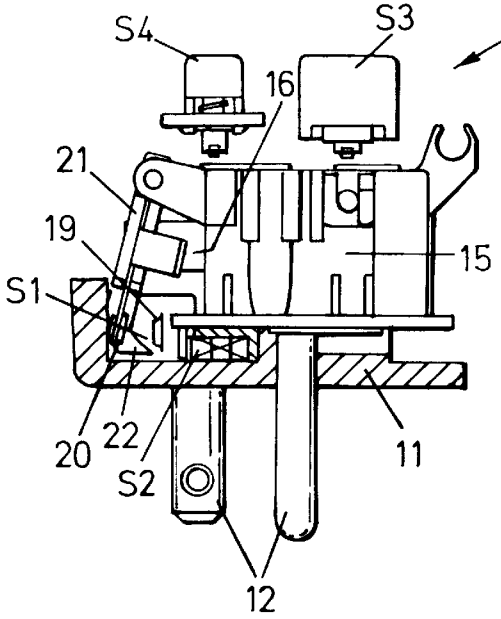
FIG. 3 is a fragmentary sectional side view of the circuit breaker of FIG. 1, in a switched-off condition.

The circuit breaker 10 incorporates a pair of principal switches S1 which are positioned between the terminal pins 12 and the fault detection circuit 14, for controlling the connection of the load to the power source by switching on and off the live and neutral lines. The switches S1 are resiliently biassed to be normally-open-and are closable by means of a solenoid 15. As best shown in FIG. 3A, the solenoid 15 has an operating shaft 16 and two windings W1 and W2 wound on an insulating former around shaft 16. The shaft 16 is movable and resiliently biassed outwards. The first winding W1 is formed by relatively thick wire of a relatively small number of turns to ensure a relatively low resistance value, whereas the second winding W2 is formed by relatively thin wire of a relatively large number of turns to insure a relatively high resistance value.

A rectifying circuit 17 is connected to the terminal pins 12 f or supplying DC power to the rest of the circuit breaker 10 and in particular the solenoid is. The windings W1 and W2 are connected in series, and across which a diode D1 is connected in parallel in an anti-flowing direction. The common ends of the windings W1 and W2 are connected to the positive output on the rectifying circuit 17 by means of a normally-closed switch S2. The other end of the first winding W1 is connected to ground via a pair of switching transistors TR. The positive output of the rectifying circuit 17 is also connected to the other end of the second winding W2 via a diode D2. At a node X beyond the diode D2, a filtering capacitor C is connected to ground. A resistor R and a triac D3 are connected in series across the node X and the ground. The node between the resistor R and the triac D3 is connected to the pair of transistors TR by means of a zener diode D4.

The circuit breaker 10 further includes an IC control circuit 18 for controlling and responding to the fault detection circuit 14. The configuration of the control circuit 18 is generally known in the art and, for the purpose of clarity, will not be described in detail. In the event of a fault detected by the fault detection circuit 14, the control circuit 18 turns off the triac D3 and hence the transistors TR. Turning off of the transistors. TR cuts off the ground connection of the windings W1 and W2. A push-button switch S3 is connected across the triac D3 for manually turning on the triac D3 momentarily to reset the circuit breaker 10 by energizing the solenoid 15 to close the switches S1.

Each of the two switches S1 has a fixed contact 19 and a resilient movable contact 20. The two movable contacts 20 are supported on opposite sides of a switching member 21 which is pivotably supported on the body of the solenoid 15 for pivotal movement to move the movable contacts 20 to and away from the corresponding fixed contacts 19. The switching number 21 is mechanically coupled with the shaft 16 for movement by the solenoid 15. The tip of the switching member 21 has an inwardly pointed striker 22.

The switch S2 is located immediately behind the striker 22 for opening by the striker 22 when the switching member 21 is pivoted by and towards the solenoid 15.

Figure 5:
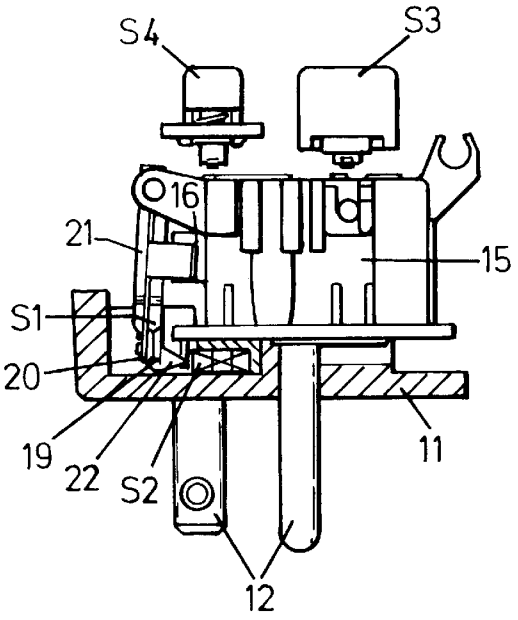
FIG. 5 is a fragmentary sectional side view of the circuit breaker,of FIG. 1, in an intermediate condition.
Figure 6:
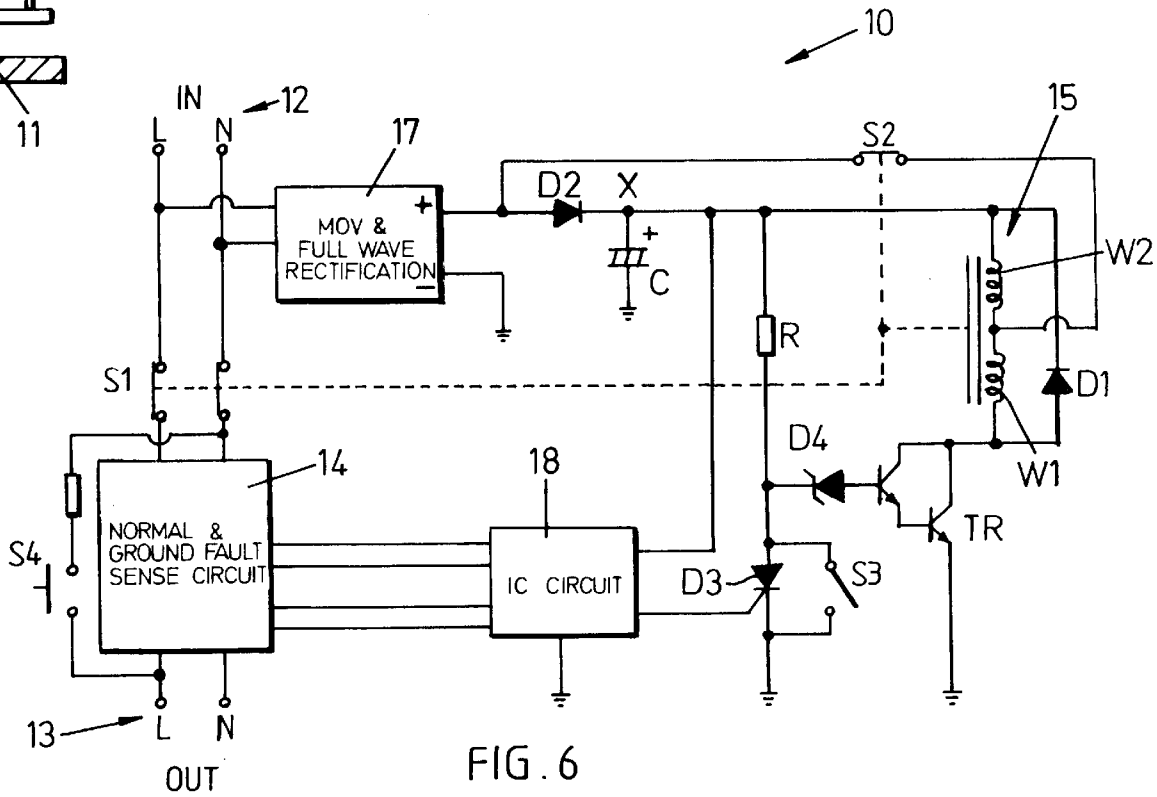
FIG. 6 is a circuit/block diagram of the circuit breaker of FIG. 5.

Reference is now made to FIG. 5 and 6 of the drawings. In operation, the circuit breaker 10 may be reset either automatically by reason of the recovery of the AC power supply or manually by pressing the switch S3 while the AC power supply is on. The IC control circuit 18 turns on the triac D3 and in turn the transistors TR in order to permit energization of the solenoid 15. Initially, by reason of the short-cut path provided by the switch S2, only the first winding W1 is energized. The first winding W1, by reason of having a relatively low resistance value, draws a relatively large current and, therefore, provides an electromagnetic force which is sufficiently large to cause the initial pivotal movement of the switch member 21. The switches S1 are closed, upon first initial pivotal movement of the, switching member 21, to re-connect the load to the AC power source.

Figure 8:
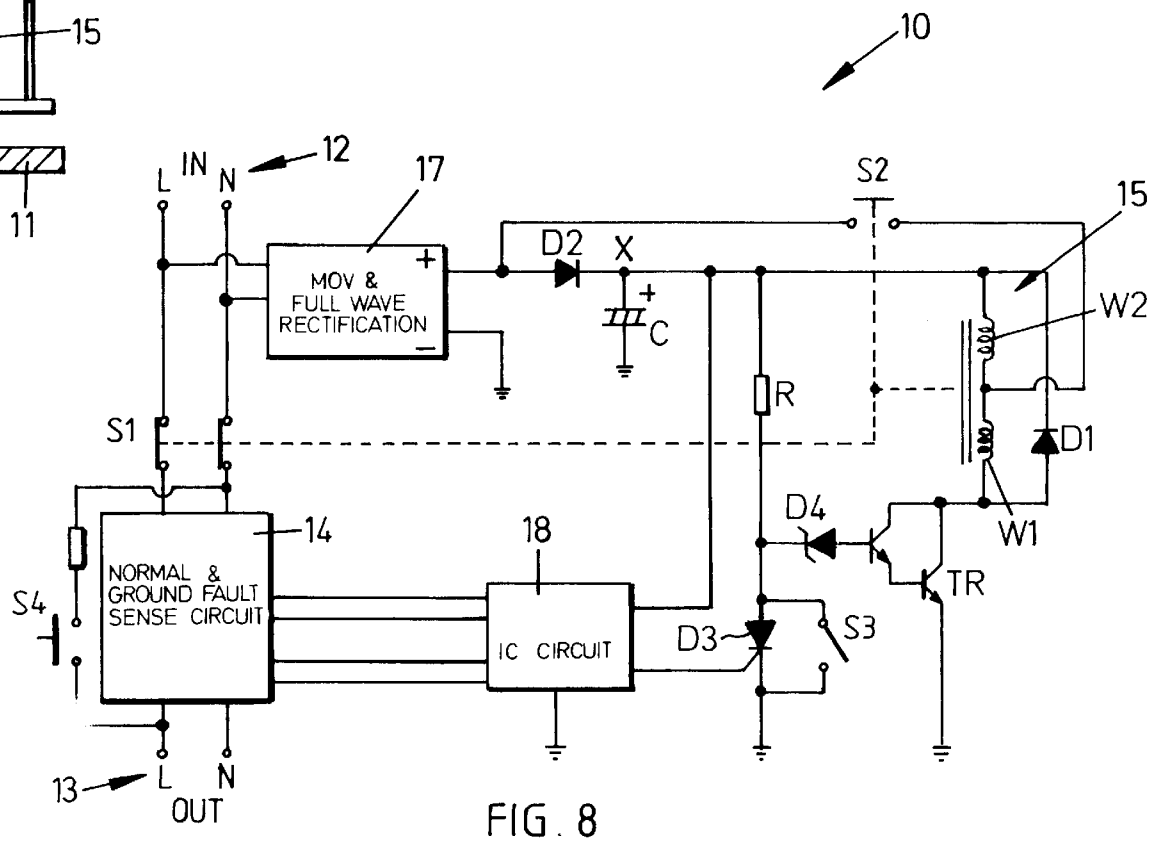
FIG. 8. is a circuit/block diagram of the circuit breaker of FIG. 7.
Figure 7:
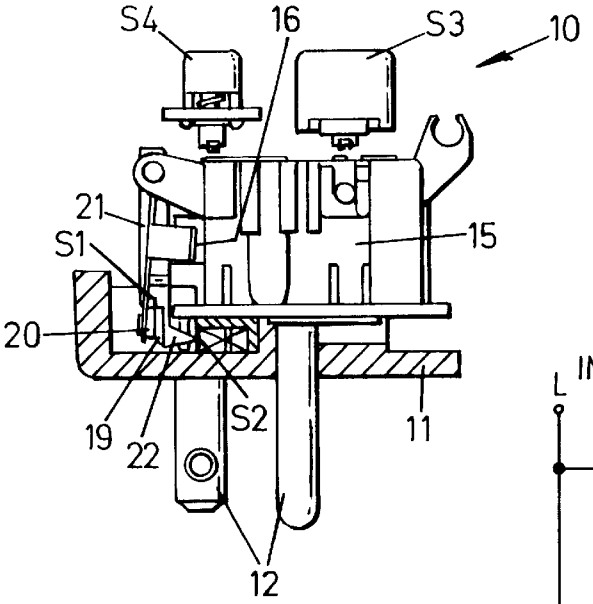
FIG. 7 is a fragmentary sectional side view of the circuit breaker of FIG. 1, is in a switched-on condition.

As shown in FIGS. 7 and 8, when the switching member 21 pivots further inward, either under the continual action of the solenoid 15 and/or by reason of momentum of the moving parts, the switch S2 is subsequently opened. It is envisaged that the switch S2 may be arranged to be opened just before the switches S1 are closed or before the movable contacts 20 of the switches S1 reach the respective fixed contacts 19. Opening of the switch S2 disables the associated short-cut path, thereby energizing the second winding W2. Now-the two windings W1 and W2 are energized in series. By reason of the second winding W2 having a relatively high resistance value, both windings W1 aid W2 together will only draw a relatively smaller current which is sufficient to enable the solenoid 15 to maintain the switching member 21 close in place and in turn the switches S1 closed.

It is clear that the switches S1 and the switch S2 are all arranged to be operated by the solenoid 15.

Upon the detection of a fault by the fault detection circuit 14, the IC control circuit 18 turns off the triac D3 and in turn the transistors TR so as to disable the energization of the solenoid 15. As a result, the switching member 21 is released to move away under the action of the resilient bias on the solenoid shaft 16, thereby causing, the switches S1 to open to disconnect the load from the AC power source.

It is to be appreciated that the switch S2 forms at least part of the resetting arrangement. The use of the switch S3 for manual resetting is optional, though preferred. The two windings W1 and W2 may be connected in parallel or in any other suitable manner. Also, the difference, in characteristics between the two windings W1 and W2, such as resistance value, may be achieved in any manner other than or in addition to the use of wires of different thickness and/or numbers of turns, for example through the use of resistor(s).

In a different embodiment, the two windings W1 and W2 may be used separately to move and to hold the switching member 21, respectively. The use of two windings W1 and W2 has the advantage of minimizing the size and production cost of the solenoid 15.

The invention has been given by way of example only, and various other modifications of and/or alterations to the described embodiment may be made by persons skilled in the art without departing from the scope of the invention as specified in the appended, claims.

I claim:

1. A circuit breaker comprising:

a pivotable switching member including a pivoting end and a free end;

a main switch for controlling the connection of a load to a power source, the main switch having:

fixed contacts, and a movable switch contact supported on the free end of the pivotable switching member and resiliently biased away from the fixed contact, wherein the free end of the pivotable switching member pivots to open and close the main switch;

a solenoid having a first winding for initially moving the movable contact towards the fixed contact and a second winding for holding the movable contact against the fixed contact;

a fault detection circuit for detecting a fault at the load and, in response, disabling the solenoid; and reset means comprising a reset switch for initially energizing the first winding and, when the movable contact is sufficiently close to or reaches the fixed contact, energizing the second winding, the reset switch being mechanically operated by the free end of the pivotable switching member, by virtue of movement of the movable contact, for controlling energization of the first and second windings.

2. The circuit breaker as claimed in claim 1, wherein the first and second windings of the solenoid are connected in series.

3. The circuit breaker as claimed in claim 1, wherein the first winding is formed of wire having a first thickness and a first number of turns and the second winding is formed by a wire having a second thickness smaller than the first thickness and a second number of turns larger than the first first number of turns.

4. The circuit breaker as claimed in claim 1, wherein the reset means energizes only the first winding in an initial stage and energizes both the first and second windings in a subsequent stage.

5. The circuit breaker as claimed in claim 1, wherein the main switch and the reset switch are both operated by the solenoid.

6. The circuit breaker as claimed in claim 1, wherein the reset means includes a manually operable switch.

7. The circuit breaker as claimed in claims 1, wherein the reset means is operates automatically upon recovery of power supplied by the power source.

8. The circuit breaker of claim 1 comprising a striker coupled to the free end of the pivotable switching member for mechanically closing the reset switch to energize the second winding.

9. The circuit breaker of claim 1 wherein the reset switch is electrically connected to the first and second windings.

10. A circuit breaker comprising:

a pivotable switching member including a pivoting end and a free end;

a switch for controlling the connection of a load to a power source, the switch having:

a fixed contacts, and a movable switch contact coupled to the free end of the pivotable switching member and resiliently biased away from the fixed contact, wherein the free end of the pivotable switching member pivots to open and close the main switch;

a solenoid having a first winding for initially moving the movable contact towards the fixed contact and a second winding for holding the movable contact against the fixed contact;

a fault detection circuit for detecting a fault at the load and, in response, disabling the solenoid; and reset means comprising a reset switch for initially energizing the first winding and, when the movable contact is sufficiently close to or reaches the fixed contact, energizing the second winding, the reset switch being mechanically operated by the free end of the pivotable switching member, the pivotable switching member operating the reset switch automatically upon recovery of power supplied by the power source.

11. The circuit breaker of claim 10 comprising a striker coupled to the free end of the pivotable switching member for mechanically closing the reset switch to energize the second winding.

12. The circuit breaker of claim 10 wherein the reset switch is electrically connected to the first and second windings.

* * * * *

UNITED STATES PATENT AND TRADEMARK OFFICE

CERTIFICATE OF CORRECTION

PATENT NO. : 5,815,363

DATED : September 29, 1998

INVENTOR(S) : Raymond Wai Hang Chu

It is certified that error appears in the above-identified patent and that said Letters Patent is hereby corrected as shown below:

Column 5, Line 12, change "claims" to --claim--;

Line 13, delete "is".

Signed and Sealed this

Nineteenth Day of January, 1999

*Attest:*

*Attesting Officer*

*Acting Commissioner of Patents and Trademarks*